US005334028A

United States Patent [19]

Melligan

[11] Patent Number: 5,334,028

[45] Date of Patent: Aug. 2, 1994

[54] GOLF SWING TRAINING PROCESS

[76] Inventor: Edmund J. Melligan, 108A Altruria Ave., Buffalo, N.Y. 14220

[21] Appl. No.: 30,635

[22] Filed: Mar. 12, 1993

Related U.S. Application Data

[63] Continuation of Ser. No. 790,421, Nov. 12, 1991, abandoned.

[51] Int. Cl.[5] ..... A63B 69/36

[52] U.S. Cl. ..... 434/252; 273/187.2; 273/188 R

[58] Field of Search ..... 273/188 R, 191 R, 191 A, 273/192, 186.1, 187.2, 188 A, 35 R; 434/252

[56] References Cited

U.S. PATENT DOCUMENTS

| | | | |
|---|---|---|---|
| 3,109,244 | 11/1963 | Trifaro et al. | 273/35 R X |
| 3,138,388 | 6/1964 | Herold | 273/188 R X |
| 4,651,994 | 3/1987 | Lee | 273/188 R X |
| 4,659,084 | 4/1987 | Vuick | 273/188 R X |
| 4,829,612 | 5/1989 | Adams | 273/188 R X |

FOREIGN PATENT DOCUMENTS

| | | | |
|---|---|---|---|
| 2192797 | 1/1980 | United Kingdom | 273/192 |

*Primary Examiner*—George J. Marlo

*Attorney, Agent, or Firm*—Bean, Kauffman & Spencer

[57] ABSTRACT

A golf swing training process comprising the steps of:

(a) providing a golf swing training device having a support frame, a force translation member, and a pivot, said support frame supporting said pivot for rotation about a generally vertical axis and enabling the vertical position of said pivot to be adjusted, said force translation member having two ends and being engaged with said pivot for pivoting said ends about said generally vertical axis;

(b) adjusting the vertical position of said pivot such that said force translation member is substantially the same distance above ground level as one's knees;

(c) assuming a golf stance wherein one's legs are generally apart and one's knees are bent such that a back of each said knee is engaged with an end of said force translation member;

(d) swinging a golf club through an arc generally across the front of one's body such that the back of one of said knees moves in a first direction against one end of said force translation member to cause said force translation member to rotate about said axis, thereby moving the other end of said force translation member against the back of the other of said knees to force said other knee to move in a direction generally opposite to said first direction.

2 Claims, 1 Drawing Sheet

GOLF SWING TRAINING PROCESS

This is a continuation of copending application Ser. No. 07/790,421 filed on Nov. 12, 1991 now abandoned.

This invention relates to a portable device useful as a training aid and a process for the development of a desirable golfer's stance and leg movement during the golf swing.

BACKGROUND OF THE INVENTION

A most popular sport among the truly civilized is that of golf, a sport where the player seeks to accurately propel a small ball having a diameter of less than about 1.64 inches into a hole, having a diameter of about 4.25 inches, from distances hundreds of yards away. Though at times it is a significant temptation to toss or kick the ball, the rules of the game require that the ball be hit using a golf club as the sole propelling implement. A typical golf club comprises a long shaft having a generally flat surface on a weighted bulbous end. The club is gripped on the shaft at a point distal the bulbous end and is swung in an arc such that the flat surface on the bulbous end contacts the ball and thus propels the ball toward the hole. The objective of the game is to propel the ball into the hole in the least number of hits, with a truly momentous occasion being the accomplishment of this feat in a single hit.

It is generally thought that the ability of the golfer to attain a controlled hit, that is one where the ball is hit in a reasonably precise direction and distance, is in large part determined by the manner in which the golfer's legs move and bend while his hands and arms swing the club at the ball. In turn it is believed that the golfer's stance contributes greatly to the leg, hand and arm movements of the swing and thus is a key element in attaining a controlled hit.

Over the years, a preferred stance has been suggested wherein the golfer desirably addresses the ball, with slightly bent knees, and seeks to swing the club with his arms through a wide arc to contact the ball. Preferably, the golfers legs tilt and turn through the arcing swing in such manner that the ball is contacted through a point in the arc where the maximum force of the golfers body can be shifted to drive the ball to its greatest distance and most accurate placement. Preferably this swinging action of the golfer is repeatable time and again such that the ball can be consistently hit with a desired force and accurate placement.

The great majority of golfers find if difficult, if not impossible, to develop a consistently repeatable swing that reasonably assures consistently hitting the ball in accurate placement and with the desired force. Many golfers obtain the assistance of professional golf teachers to review their swing and help teach them an appropriate swing that will allow them to become more accurate and consistent. Many teachers have developed tricks and devices which appear to assist them in training the golfer to attain a desirable swing. As a result, multiple devices have been developed to assist the golfer in developing a consistently repeatable swing, most of which tend to restrain the body movement of the golfer within a predetermined swing path.

It is an object of the present invention to provide a device that assists the golfer in developing a repeatable swing.

It is also an object of the invention to provide a device that improves the swing of the golfer from a preferred stance.

It is a further object of the invention to provide a device and/or process that trains the golfer to shift his weight and bend his knees in a preferred swing activity.

These and other objects of the invention will be apparent from the foregoing.

DESCRIPTION OF THE INVENTION

The present invention relates to a golf swing training device, useful for right or left handed golfers, that utilizes a naturally occurring leg movement to initiate and promote the shifting of the body weight and upper torso of a golfer, in a preferred golfer's club swing form.

Applicant has found that a weight shift and turning of the upper torso of a typical golfer's body can be caused to occur during the golf swing, by coupling a naturally occurring rearward movement of the knee area of a first leg to the initiation and promotion of a forward movement of the knee area of the other leg. When such first leg movement is properly mechanically coupled to movement of the other leg, the result tends to cause the weight of the golfer to shift and the upper torso to rotate in what is generally considered a preferred golf swing form that maximizes the power and the accuracy of the golfer's swing.

The golf swing training device of the invention provides a means by which a typically naturally occurring backward movement of the back of the knee area of the golfer's leading leg (e.g. the leg in the direction of the swing), can be translated to initiate and/or promote the imposition of a force upon back of the golfer's other knee. The imposition of an appropriate force upon the other knee causes the other knee to bend and/or rotate in a preferred golf swing form.

The golf swing training device of the invention comprises a support frame having pivotally mounted thereto, in generally horizontal arrangement, an elongated force translation member. Typically the pivoting means comprises a rotation means and preferably the rotation means comprises a swivel means. The elongated force translation member must be of sufficient length to engage the rear of both of a standing golfer's knees, at the same time, while the golfer stands with legs spread apart.

The support frame of the invention is configured to comprise a firm supporting mount for the pivot means, at a point above ground level between about the golfer's legs. Typically it is preferred that the pivot means be positioned from about 8 inches to about 24 inches above ground level. By ground level is meant that level upon which the golfer is standing, whether it be ground, concrete, floor a platform or the like.

Typically it is preferred that the support frame be adjustable to allow height adjustment of the pivot means to a convenient level by different height golfers. The specific configuration of the support frame can vary widely, in that it may comprise a pole or post that can be firmly anchored, preferably adjustably, in the ground, concrete pad, platform or the like on which the golfer may be standing or may even be anchored to an adjacent wall or the like. Alternately, the support frame may comprise a tripod or the like. In a preferred embodiment the support frame comprises a base plate or the like to which the support frame is connected, and on which the golfer may stand so that his weight can be used to further anchor the support frame.

By pivot means is meant the means through which the force translation member pivots about an axis of the support frame. Such means need not provide 360° rotation about an axis but can be any convenient means that allows sufficient movement of the force translation member about a pivot point located between about the golfer's legs to enable a proper swing movement. Typically however it is preferred that the pivot means comprises a rotational means such as a swivel means that allows both horizontal and vertical oblique movement so that the ends of the force translation member engaging the rear of the knees can maintain their position through at least minor height changes of the knee during the golf swing process.

The force translation member generally comprises an elongated member having two ends for engagement with the legs and/or knees of the golfer. Typically, the member comprises a rod or the like, that is mounted to the pivot means, typically near the central point in its length. Typically, the force translation member comprises a two piece structure with the pieces mounted opposite each other at opposite points on a rotation means. Generally, the force translation member can simply be a rod or the like that conveniently engages the rear of the knee area of the legs of the golfer. Typically, the member comprises a generally straight rod, but it should be understood that it is contemplated as within the invention to include any convenient shape or configuration that can engage the legs and/or knees of the golfer.

The force transmission member should be of sufficient length to engage the rear knee area of a first leg of the golfer, extend to the pivot means and thereafter extend to engage the rear knee area of the other leg, when the golfer is in a standing position, feet spread apart. The pivot means is generally positioned between the points of engagement of the legs with the force translation member. Thus, lateral movement of one end of the force translation member, caused by engagement by a backwardly moving first leg, will cause a distal end of the force translation member to engage and force a forward movement of the other leg.

In the process of the invention, the golfer assumes a golfing stance generally centering his legs about over about the rotation means mounting the force translation member to the support frame. With the golfer standing with legs apart and knees slightly bent, he moves into a position wherein the force translation member engages the backs of both legs at about the back of the knees. The golf ball is positioned on the ground in front of the golfer, at a distance therefrom that he can conveniently strike the ball by swinging a golf club in a relaxed swinging arc. As the golfer swings the club in a backward arc to reach the rearmost starting position for a forward arcing, ball contacting swing, the back of the knee of the leg rearward to the direction of the forward swing typically naturally moves backward. This backward movement of the back of the knee of the rearward leg, forces one end of the force translation member backward, causing the force translation member to rotate on the pivot and forcing the distal end of the force translation member against the back of the knee of the forward leg. This force on the back of the forward knee causes the knee of the forward leg to move forward at the top of the golfer's backswing.

As the golfer swings the club head from the top of the backswing toward the ball, the back of the knee of the leg forward of the direction of the forward swing typically naturally moves backward. This backward movement of the back of the knee of the forward leg causes the force translation member to rotate on the pivot and the other end of the force translation member moves against the back of the knee of the rearward leg. This force on the back of the rearward leg causes the knee of the rearward leg to move forward. Typically during this process the forward momentum of the golf swing tends to turn the golfer's shoulders during the swing such that this momentum, coupled with the force generated through the force translation member against the back of the knee of the rearward leg, tends to force the rearward knee both forward and in the direction of the swing. The forced movement of the rearward knee in an arc in the direction of the swing tends to cause the golfer's body to rotate and particularly tends to cause the upper torso to rotate so that both the torso and the shoulders of the golfer tend toward perpendicular alignment with the direction of the swing. Such movement is a preferred form of a golfer's swing.

In a preferred embodiment the support frame comprises an elongated rod, adjustably mounted in a tubular receiver that is attached to a base plate. The base plate is preferably large enough so it can accommodate a standing golfer such that the golfer's weight acts in anchoring the support frame in a generally stable perpendicular arrangement. The base plate may contain impressions, markings or the like that may be suitable for assisting the golfer in properly positioning his feet. The base plate may also contain cleats, non-skid coverings or the like that help maintain the plate and/or the golfer in position. The rotation means preferably comprises a swivel means attached at the top of the elongated rod and the force translation means extends generally perpendicular to the elongated rod. The height of the elongated rod is adjustable at the receiver such that it can be adjustably extended upward between about the golfer's legs for positioning of the cross member at about the back of the knees of the golfers legs. It should be understood that the rod can be solid or hollow and can be of any convenient shape or cross-sectional configuration.

In another embodiment, the support frame is configured for insertion into the ground. For example the support frame may be an adjustable length pole or the like having an end configured for insertion into the ground. In still another embodiment the support frame may be a tripod or the like structure that is anchored to the ground and comprises an adjustable height rod for mounting a rotatable means connected to a force translation means.

These and other aspects of the invention will become more apparent by reference to the following detailed disclosure and appended drawings.

DETAILED DESCRIPTION OF THE INVENTION

Figure 1:
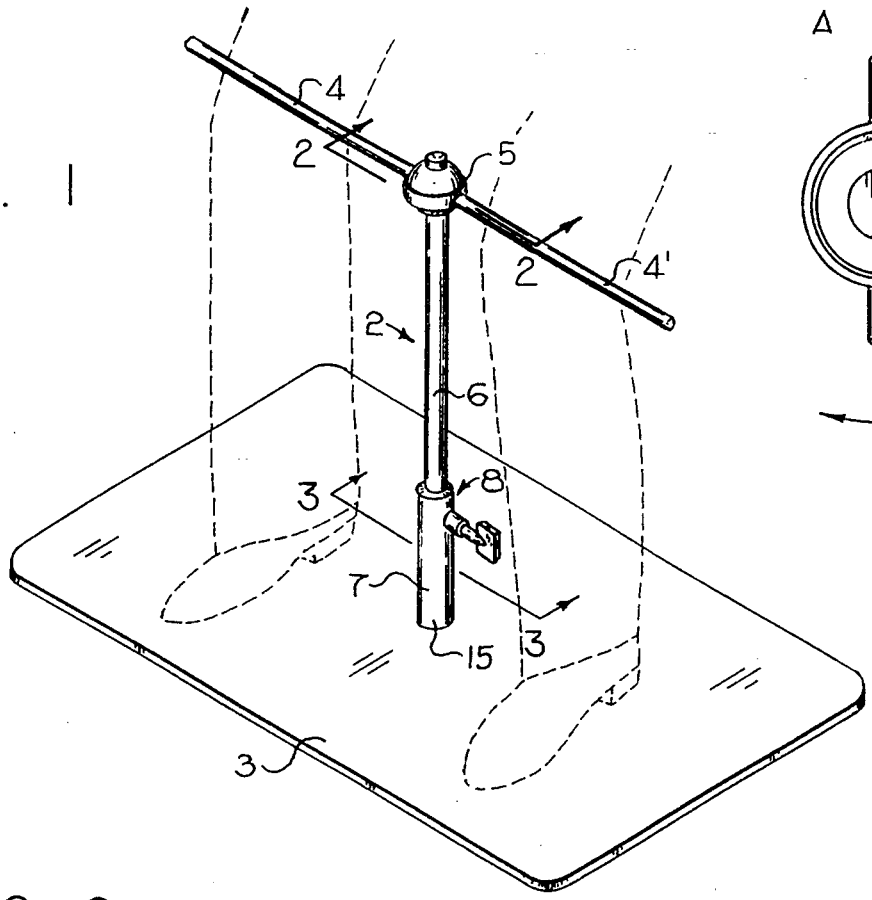
FIG. 1 is a perspective view of an embodiment of the invention showing placement of the device between a golfer's legs.

Referring now to the drawings, and particularly to FIG. 1, wherein an embodiment of a golf swing training device of the invention is provided. Therein, golf swing training device 1 comprises base 3, support frame 2, force translation member 4 and pivot means 5. Support base 3 comprises a generally flat plate, preferably formed from a lightweight metal or plastic, dimensioned to be large enough to accommodate a standing golfer with feet spread apart. Though not shown in the drawings, the plate may comprise cleats, a non-skid covering or the like to maintain the plate and/or golfer in position. The plate may be anchored by anchor bolts or the like or the plate may comprise a concrete pad or the like. Typically the upper surface comprises markings or the like to designate the placement of the golfer's feet, and/or to reduce foot slippage.

Figure 3:
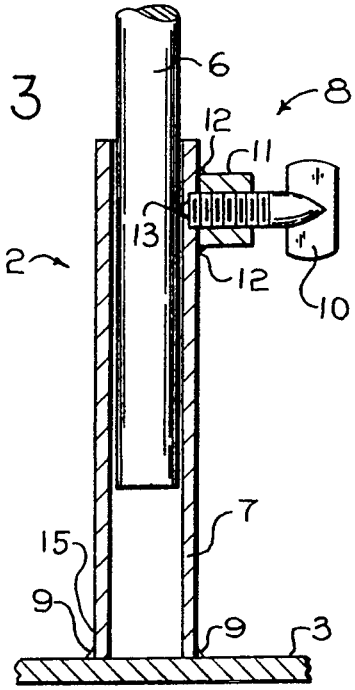
FIG. 3 is a sectional view of the adjustable support frame of the embodiment of FIG. 1 taken along line 3—3

Support frame 2 is illustrated in the drawings as being an elongated member comprising rod 6 and tubular receiver 7, the tubular receiver being fixed to base 3 at its end 15, such that receiver 7 extends generally perpendicular from base 3 and is configured to receive rod 6. Height adjustment of the support frame is achieved in the illustrated embodiment by means of varying the depth which rod 6 is inserted in tubular receiver 7. FIG. 3 illustrates adjustment means 8 as being a jam bolt means, generally comprising a wing bolt 10 that threads into nut 11, welded 12 to tubular receiver 7. Tightening down wing bolt 10 causes tip 13 to engage rod 6, securing it to prevent it from moving upwardly or downwardly in tubular receiver 7.

Tubular receiver 7 can be fixed to base 3 through multiple means. In the instant embodiment, FIG. 3 illustrates the attachment of tubular receiver 7 to base 3 through weld 9. Though not specifically illustrated in the drawings, tubular receiver 7 can also be threaded into mating threads in base 3. It should be understood that various convenient means may be used to mount tubular receiver 7 to base 3. For example they may be formed from a metallic, plastic or the like material as a continuous unit or may be separate units welded and/or glued together for attachment.

Similarly, rod 6 may be metallic or may be comprised of a plastic material or the like and may be solid or tubular. It should be understood that neither tubular receiver 7 nor rod 6 need be round but can be any convenient shape. It should also be understood that adjusting means 8 need not comprise a wing bolt but can comprise any suitable means to provide adjustable height of rod 6 in tubular receiver 7.

Pivot means, illustrated as swivel 5, is generally mounted to rod 6, at the end distal from tubular receiver 7. Typically swivel 5 is removably connected to the supporting rod, generally by mating threaded means, snap fastening means or the like, but it may also be permanently affixed by welding, gluing or the like.

The force translation men%her generally comprises a suitable rod or the like that extends in opposite directions from swivel means 5 and is sufficiently long to engage the rear of the golfer's knees. In the illustrated embodiment, the force translation member comprises rods 4 and 4' which extend in opposite directions from opposite sides of swivel 5. Generally, the rods comprising the force translation member must be sufficiently rigid that the force applied by the back of a knee on an end of one rod will be directly translated, with generally equivalent intensity, to the back of the other knee by the end of the other rod, when the pivot point is equidistant between the golfer's knees.

It should be understood that under some circumstances it may be desirable for the pivot point to be placed at a position that is not equidistant from the knees of the golfer. Such circumstance may come about when it is desired to exaggerate or retard the forward movement of a knee in relation to the backward movement of the other knee. The instant invention contemplates such variation and specifically provides for non-equidistant placement of the pivot point from the golfers knees.

Figure 6:
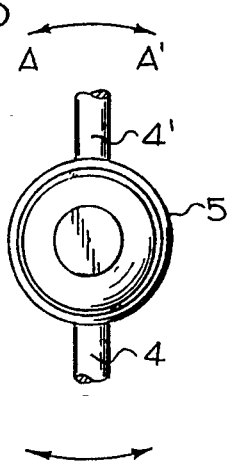
FIG. 6 is a top elevation of the swivel of the embodiment of FIG. 1.
Figure 2:
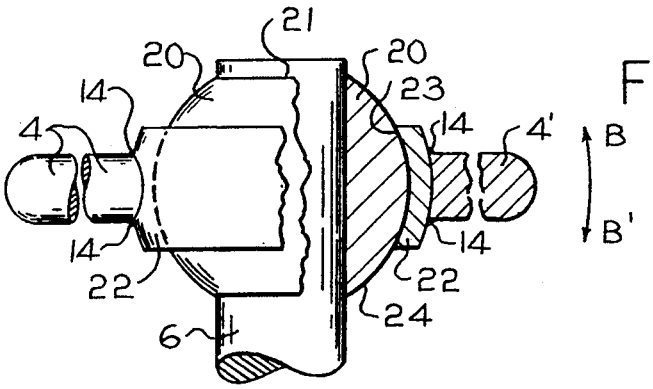
FIG. 2 is a sectional view of the swivel of the embodiment of FIG. 1, taken along line 2—2.
Figure 4:
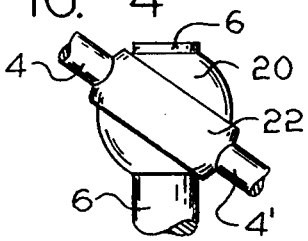
FIG. 4 is a side elevation of the swivel of the embodiment of FIG. 1 showing swivel movement along an axis of the support frame.
Figure 5:
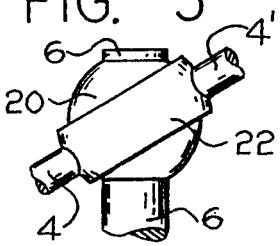
FIG. 5 is another side elevation of the swivel of the embodiment of FIG. 1 showing swivel movement in a further direction along an axis of the support frame.

FIGS. 2, 4 and 5 illustrate an embodiment of swivel 5, comprising a spherical race 20 containing mounting hole 21 and having encompassing it rotating cuff 22. Interior surface 23 of rotating cuff 22 is configured to generally conform to spherical surface 24 of spherical race 20 and the two surfaces mate in a typical bearing arrangement such that cuff 22 can rotate about spherical race 20 in lateral and angular directions. In the illustrated embodiment, the force translation member comprises elongated rods 4 and 4', which are attached at one end to opposite sides of rotating cuff 22 by weld 14 such that the force translation members extend in a generally common plane from swivel 5:

FIGS. 2, 4, 5 and 6 illustrate the rotational movement of swivel 5, with FIG. 6 illustrating the lateral movement illustrated by arrow A, A' and FIGS. 2, 4 and 5 illustrating angular movement from the vertical as illustrated by arrow B, B'.

The illustrated swivel can be mounted to rod 6 by various convenient means. Typically, spherical race 20 and rod 6 comprise mating threads for mounting the swivel thereon. It should be understood however that the swivel can be mounted to the supporting member by welding, gluing, bolting, press fitting, pin means or any of a various well known mounting means. Generally, however, it is preferred to use releasable means so that the swivel can be easily removed from rod 6 for storage and the like.

I claim:

1. A golf swing training process comprising, providing a golf swing training device having a support frame, a force translation member and pivot means; said support frame being configured to support said pivot means for pivoting about a generally vertical axis; said force translation member having two ends and being engaged with said pivot means for pivoting said ends about said generally vertical axis in response to engagement of said ends at about the knees of a standing golfer; a golfer, standing with legs generally apart and knees bent, such that the back of each said golfer's bent knees engage an end of said force translation member; said golfer swinging a golf club through an arc generally planar to the front of said golfer's body such that as the back of one knee of said golfer forces against an end of said force translation member, said force translation member pivots about said axis and an other end of said force translation member forces against the back of the other knee of said golfer in substantially an opposite direction.

2. A golf swing training process comprising the steps of:

(a) providing a golf swing training device having a support frame, a force translation member, and pivot means, said support frame being configured to support said pivot means for pivoting about a generally vertical axis and having means for adjusting the vertical position of said pivot means, said force translation member having two ends and being engaged with said pivot means for pivoting said ends about said generally vertical axis;

(b) adjusting the vertical position of said pivot means such that said force translation member is substantially the same distance above ground level as one's knees;

(c) assuming a golf stance wherein one's legs are generally apart and one's knees are bent such that a back of each said knee is engaged with an end of said force translation member;

(d) swinging a golf club through an arc generally across the front of one's body such that the back of one of said knees moves in a first direction against an end of said force translation member to cause said force translation member to pivot about said axis, thereby moving another end of said force translation member against the back of the other of said knees to force said other knee to move in a direction generally opposite to said first direction.

* * * * *